United States Patent [19]

Hübner et al.

[11] Patent Number: 4,741,011

[45] Date of Patent: Apr. 26, 1988

[54] X-RAY TUBE COMPRISING AN ANODE DISC WHICH IS AT LEAST PARTLY MADE OF PYROLYTIC GRAPHITE

[75] Inventors: Horst Hübner; Bernhard Lersmacher, both of Aachen; Hans Lydtin, Stolberg, all of Fed. Rep. of Germany

[73] Assignee: U.S. Philips Corp., New York, N.Y.

[21] Appl. No.: 316,165

[22] Filed: Oct. 29, 1981

[30] Foreign Application Priority Data

Nov. 3, 1980 [DE] Fed. Rep. of Germany ..... 3041249

[51] Int. Cl.[4] ..... H01J 35/10

[52] U.S. Cl. ..... 378/128; 378/144

[58] Field of Search ..... 378/125, 128, 144

[56] References Cited

U.S. PATENT DOCUMENTS

| | | | |
|---|---|---|---|
| 3,710,170 | 1/1973 | Friedel | 378/125 |
| 3,819,971 | 6/1974 | Kaplan et al. | 378/144 |
| 4,335,327 | 6/1982 | Waugh et al. | 378/144 X |
| 4,344,012 | 8/1982 | Hübner et al. | 313/311 |

FOREIGN PATENT DOCUMENTS

| | | | |
|---|---|---|---|
| 2440988 | 8/1973 | Fed. Rep. of Germany | 378/144 |

*Primary Examiner*—David K. Moore
*Assistant Examiner*—Sandra L. O'Shea
*Attorney, Agent, or Firm*—Paul R. Miller

[57] ABSTRACT

A basic body for an anode disc is provided with laminations which are situated at a short distance from one another. Pyrolytic graphite is provided in the narrow intermediate spaces between the laminations by deposition of carbon from the gaseous state. Because of the small distances between laminations, these intermediate spaces are quickly filled with pyrolytic graphite.

12 Claims, 3 Drawing Sheets

X-RAY TUBE COMPRISING AN ANODE DISC WHICH IS AT LEAST PARTLY MADE OF PYROLYTIC GRAPHITE

The invention relates to an X-ray tube, comprising an anode with an anode disc which contains pyrolytic graphite at least at the area of the focal path.

An anode disc of this kind is known from German Offenlegungsschrift No. 29 10 138 (corresponding to U.S. Pat. No. 4,344,012). Anode discs of this kind offer the advantage that the heat developed in the focal path is quickly dissipated by the part of the anode disc which contains pyrolytic graphite. The ring of pyrolytic graphite described in this Offenlegungsschrift which encloses the focal path has dimensions of preferably approximately 10 mm in the axial and the radial direction.

Such pyrolytic graphite rings can be manufactured by direct continuous deposition of carbon from the gaseous phase or by assembly of separate segments thus manufactured. Considering the layer deposition rate of approximately 2 μm per minute which can be achieved at present, in both cases coating times of up to 100 hours are required for the manufacture, so that high costs are incurred and a severe strain is imposed on the high-temperature equipment used. This is a general problem encountered in the manufacture of bodies with comparitively thick layers of pyrolytic graphite.

It is an object of the invention to provide an anode disc which can be manufactured in a shorter period of time and which is, therefore, less expensive.

This object in accordance with the invention is achieved in that an X-ray tube of the kind set forth is characterized in that the disc comprises laminations which are situated at a small distance from one another, the space between the laminations being filled with pyrolytic graphite.

Due to the use of laminations, the surface on which the pyrolytic graphite is deposited is increased, with the result that the required coating time can be substantially reduced. Moreover, it is now merely necessary to fill the comparitively narrow space between two laminations with graphite. An intermediate space having a width of 1 mm has been filled up when a layer of pyrolytic graphite having a thickness of 0.5 mm has been deposited on both adjoining laminations. At a deposition rate of 2 μm per minute, only approximately four hours are then required in comparison with the customary one hundred hours.

In order to achieve complete filling of the intermediate space during the deposition of pyrographite, it is advantageous to reudce the gas pressure and the substrate temperature when the intermediate space between the laminations has almost been completely filled. Thus, premature closing and inclusion of a hollow space are prevented. Therefore, the intermediate spaces are preferably shaped so that the increased growth at the corners at the entrance of the slits is compensated for by a corresponding widening of the entrance opening. This is achieved, for example, in that the relevant corners of the laminations are removed by mechanical or chemical methods.

Various possibilities exist for the arrangement of the laminations of an anode disc. In one embodiment in accordance with the invention, the laminations are situated in planes which contain the axis of rotation. The focal path may then be arranged on an end face as well as on a surface of the cylindrical body thus formed. In a further embodiment, the laminations are concentric and parallel to the axis of rotation and the layer which serves as the focal path is made of a heavy metal and is arranged on a conical end surface, symmetrical with respect to the axis of rotation, of the body thus formed. The directions of the highest thermal conductivity then extend parallel with respect to the axis of rotation (because the growth direction of the pyrolytic graphite layer is perpendicular to the axis of rotation). Suitable dissipation of heat by the pyrolytic graphite layer is then ensured only if the focal path is arranged on a conical end face which is symmetrical with respect to the axis of rotation and which intersects the axis of rotation at an angle other than zero (generally from 70° to 80°). If the focal path were provided on the outer surface, the pyrolytic graphite layer would even disturb the dissipation of heat.

In a further embodiment, a circular basic body is provided with laminations which extend concentrically with respect to a central axis and in the axial direction, said structure being covered with pyrolytic graphite so that the intermediate spaces between the laminations are filled, the part of the basic body which connects the laminations having been removed by mechanical operations. The removal of the part of the basic body which connects the laminations is in this case desirable for suitable conduction of heat to the environment.

In another embodiment yet in accordance with the invention the pyrolytic graphite layer has been partly removed from the side of the basic body on which the focal path is to be arranged, before the layer of heavy metal is provided. As a result, the occurrence of poor thermal conductivity due to the deposition of a layer of heavy metal on the pyrolytic graphite layer without prior treatment is prevented. In that case the surfaces of higher thermal conductivity in the layer of pyrolytic graphite would extend parallel to the boundary surface of the layer of heavy metal.

Some preferred embodiments of anode discs in accordance with the invention will be described in detail hereinafter.

Figure 1:
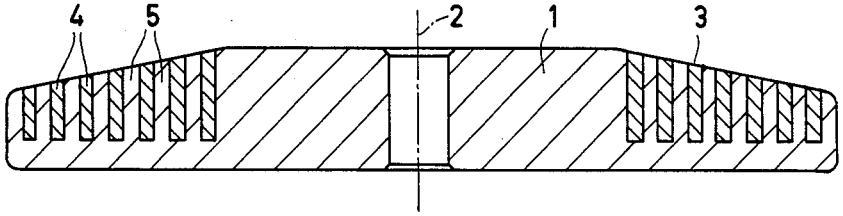
FIG. 1 is a sectional view of a first embodiment.

FIG. 1 shows a disc-shaped basic body 1 which is symmetric with respect to the axis of rotation 2. At the area of the focal path to be deposited, the basic body 1 has an inclined surface 3 whose shape corresponds approximately to the shape of the focal path to be deposited later and which intersects the axis of rotation 2 at an angle of preferably from 70° to 80°. In principle, however, a circular disc body without bevelled cylinder surfaces could also be used. At the area of the focal path the basic body 1 comprises a number of grooves 4 which are concentric to the axis of rotation 2 and wherebetween there are formed concentric bridges or ridges 5 which are referred to hereinafter as laminations and which extend approximately parallel to the axis of rotation. The grooves can be formed, for example, by lathe turning.

The grooves 4 thus formed are subsequently filled with pyrolytic graphite by deposition of carbon from the gaseous phase. Deposition methods of this kind are known, for example, from Philips Technische Rundschau, 37th Edition, No. 8, pages 205 to 213. Use is preferably made of the described "hot-wall" method, because during all phases of the coating operation optimum heating, that is to say a homogeneous temperature distribution, in the basic body is thus ensured. On the other hand, however, the "cold-wall" method described in this publication can also be used, because on the basis of the rotationally symmetrical shape of the basic body an at least approximately homogeneous temperture distribution can be obtained (for example, during induction heating).

Figure 2:
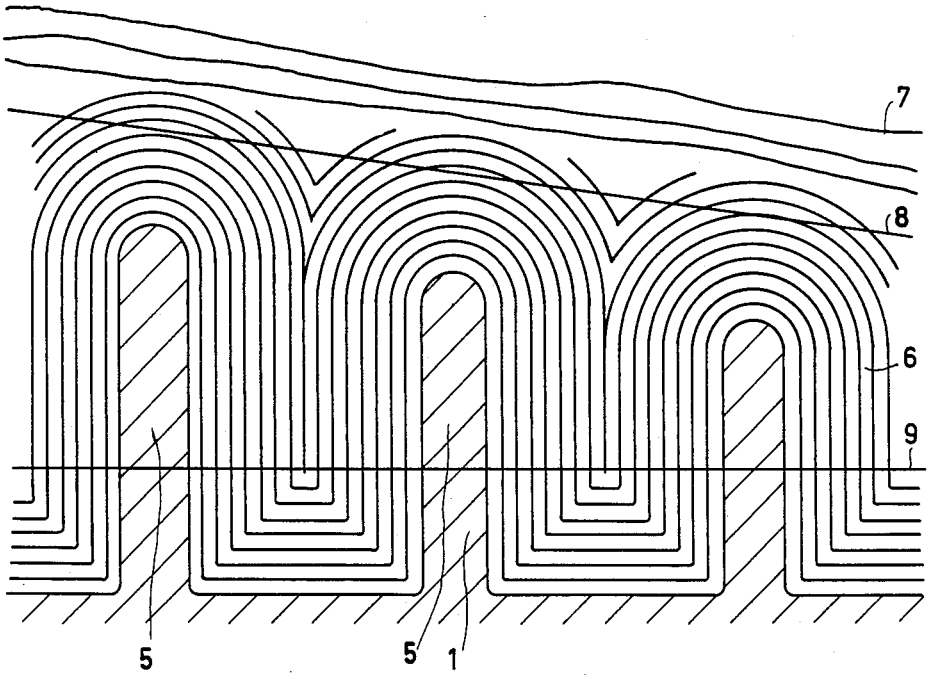
FIG. 2 shows a detail of FIG. 1 at a substantially larger scale.

FIG. 2 shows a detail of the secitonal view of the basic body 1 in FIG. 1 after deposition of pyrolytic graphite. Thin lines denote the interfaces of the pyrolytic graphite layer during the separate phases of the deposition method. It appears that these lines follow the contour of the basic body more closely as they are situated nearer to the body. This means that at the beginning of the deposition method the contours of the basic body are hardly changed by the coating operation (they merely become larger), while during the end phase, i.e. after the filing of the intermediate spaces with pyrolytic graphite, they are completely different; the upper boundary 7 of the pyrographite layer 6 is only slightly curved and extends approximately at the same distance from the end faces of the laminations 5.

As has already been stated, the thermal conductivity of pyrolytic graphite is maximum in the direction perpendicular to the growth direction of the layer while it is minimum in the direction parallel thereto. Therefore, the thin lines at the same time indicate the directions in which optimum dissipation of heat is possible. If the surface 7 were to be provided with a layer of heavy metal 16, shown by example in FIG. 1, (tungsten or a tungsten alloy, which can be provided by deposition from the gaseous phase or by soldering of a thicker layer as described in German Offenlegungsschrift No. 29 10 138 corresponding to U.S. Pat. No. 4,344,012), possibly after a mechanical operation such as grinding, the heat developed during the use of such a layer of heavy metal 16 as the focal path would hardly be dissipated, because the surfaces of the pyrolytic graphite layer offering the highest thermal conductivity would then extend approximately parallel to the boundary surface of the layer of heavy metal 16. Therefore, the pyrographite coating must be ground down substantially further as indicated by the line 8. When the layer of heavy metal 16 is deposited on the surface thus ground down, the heat dissipation is substantially improved.

When the laminations are comparatively thick, the grinding plane 8 should be situated in the plane of the end faces of the laminations 5. For lamination thicknesses of approximately 100 μm or for laminations having pointed or rounded end faces, as shown in the FIGS. 3 and 4, it suffices for suitable dissipation of heat that the distance between the grinding plane 8 and the end faces of the laminations amounts to approximately from 10 to 20% of the distance between the laminations.

It appears from the foregoing that the laminations must be arranged at a distance in the order of magnitude of millimeters (0.1 to maximum 4 mm) from one another. The smaller the distance, the shorter the duration of the deposition process will be. The laminations themselves should be as thin as possible (0.1 to 3 mm), preferably thinner than the value corresponding to the spacing of the laminations. The thinner the laminations are in comparison with their spacing, the larger the pyrolytic graphite constituent at the area of the focal path will be (so that the heat conductivity is improved) and the less pyrolytic graphite will have to be removed by grinding in order to obtain a suitable thermal contact with the focal path.

FIG. 2 also shows that the surfaces 9 offering the highest thermal conductivity extend at the bottom of and approximately parallel to the groove. This means that it is very difficult to transport the heat into the basic body and to remove it to the environment. As it is shown in FIG. 2, therefore, the part of the basic body which interconnects the laminations 5 and a small part of the laminations themselves must be removed by grinding. Any lack of mechanical strength then occurring can be compensated for, for example, by means of a suitable holder which surrounds the anode disc.

The body thus treated constitutes the anode disc (after deposition of the layer of heavy 16 metal on the end face 9). The heat is dissipated mainly in the layer of pyrolytic graphite between the laminations. Due to the tooth-like arrangement of the pyrographite layers and the laminations, a high mechanical strength is obtained.

Figure 3:
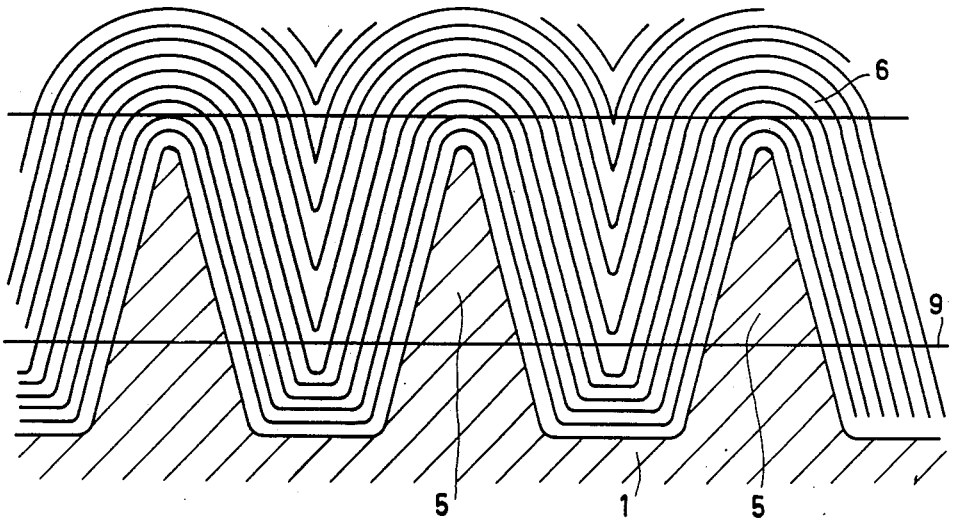
FIGS. 3 and 4 show modifications of the embodiment shown in the FIGS. 1 and 2, respectively.
Figure 4:
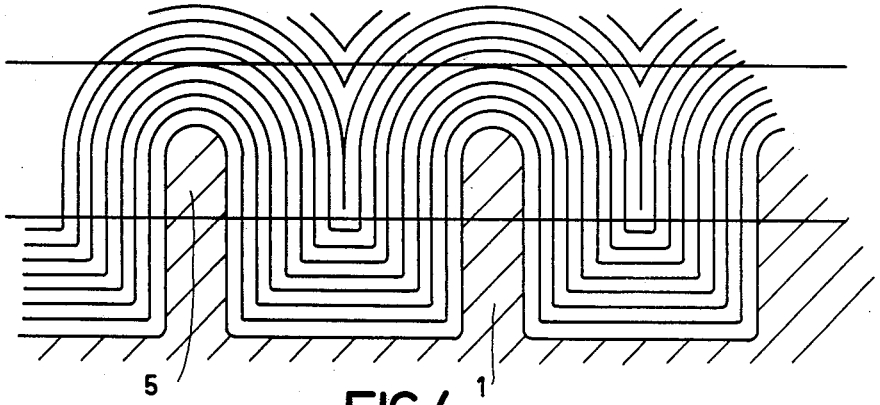

The FIGS. 3 and 4 show a detail of a basic body which is covered with pyrographite and which corresponds to FIG. 2, although the laminations are pointed (FIG. 3) or rounded (FIG. 4) and project each time equally far from the basic body 1. The reference numerals used correspond to those used in FIG. 2. The grinding plane for deposition of the layer of heavy metal must extend in accordance with the position of the focal path. This offers the additional advantage that the surfaces of the pyrolytic graphite layer 6 which offer the highest thermal conductivity are always intersected at an algle other than zero. It also appears from the Figures 3 and 4, however, that even if the height of the laminations were to decrease from the inside towards the outside, so that the grinding level would extend parallel to the tips of the laminations, the surface for the deposition of the layer of heavy metal would not have to be ground down as far as in FIG. 2, because the lines indicating the highest thermal conductivity extend parallel to the connecting line of the lamination tips in only a comparatively small zone.

Figure 5:
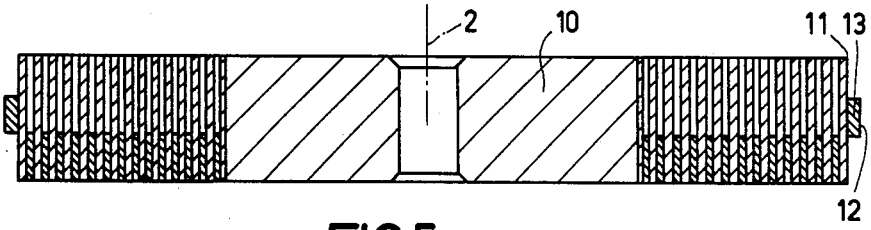
FIG. 5 shows a further embodiment of an anode disc.

It has been assumed thus far that use is made of a one-piece basic body in which the laminar structure is realized by mechanical working. FIG. 5 shows a basic body 10 which consists of several parts and which can be particularly simply manufactured. The body is manufactured by winding two graphite foils 11 and 12, of different width which are commercially available, for example, as "Sigraflex" from Messrs. Sigri and as "Papyex" from Deutsche Carbone AG. Winding is performed so that the lower longitudinal edges of both graphite foils exactly register. Thus, a helical groove is formed between two successive layers of the wider graphite foil 11 due to the presence of the intermediate narrower grahite foil 12 with, the depth of the groove corresponding to the difference in width between the two foils and, the width of the groove corresponding to the thickness of the narrower graphite foil 12. It may be advantageous for the narrower graphite foil 12 to be thicker than the wider graphite foil 11, because in that case more pyrolytic graphite can be deposited in the grooves.

The coating with pyrolytic graphite is realized as described with reference to FIG. 1.

As has been described with reference to FIG. 2, in this embodiment it is again advantageous to improve the dissipation of heat by removal by grinding of the lower part of the basic body in which the narrower graphite foil 12 is present, so that the pyrographite coating between the individual layers of the remaining upper part of the wider graphite foil 11 reaches the lower side of the anode disc body thus obtained. The strength is improved by a metal ring 13 arranged on the outer circumference thereof.

Figure 6:
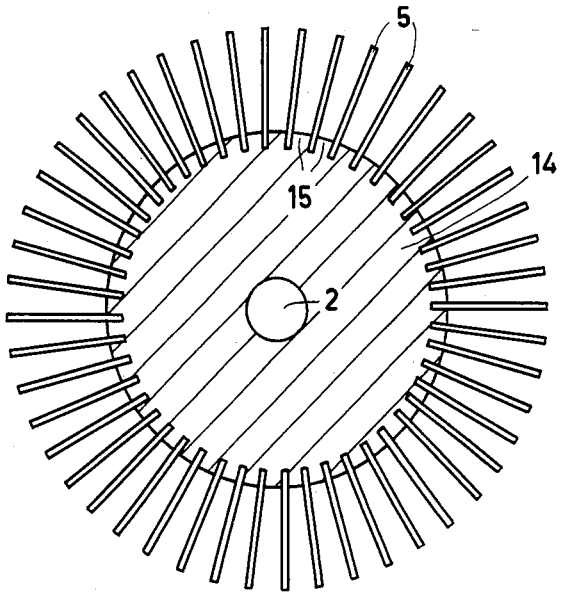
FIG. 6 is a plan view of a third embodiment.
Figure 7:
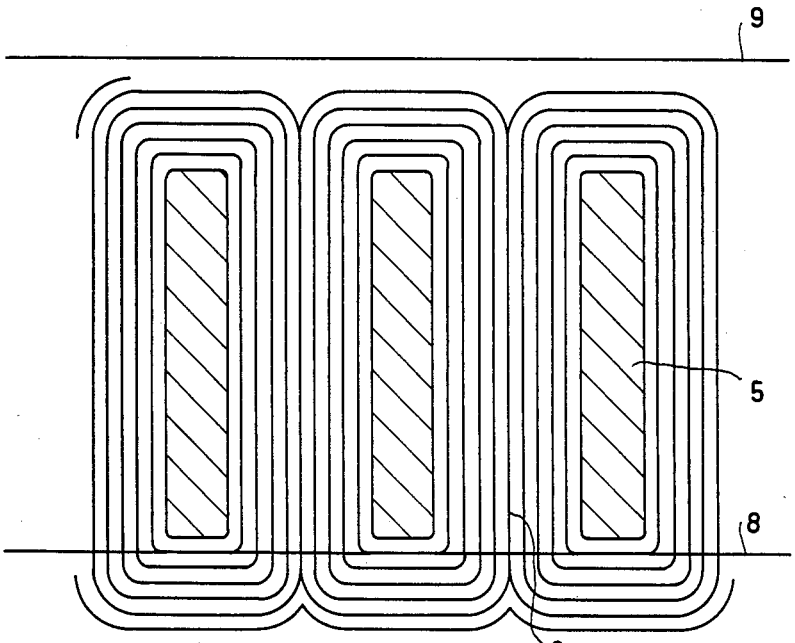
FIG. 7 is a side elevation and a sectional view of the embodiment shown in FIG. 6.

In the embodiments described thus far, the laminations extend concentric to the axis of rotation 2, but in the embodiment which is shown in a plan view in FIG. 6 and in a side elevation in FIG. 7 (detail), however, the laminations extend radially, i.e. they are situated in planes which contain the axis of rotation. The laminations could in principle be formed by milling of a circular body, but this would be a very labour-intensive operation. In the embodiment shown in FIG. 6, the laminations 5 are fomed by flat plates which are secured to the outer circumference of a circular body 14 in a regular distribution. The laminations can be clamped, for example, in shallow grooves 15 which are provided in the circumference of the circular body 14. The subseqent coating with pyrographite provides a further reinforcement of the total system. The laminations may be made of electrographite, pyrolytic graphite, graphite foils, metal foils or metal carbide foils.

In order to improve the dissipation of heat, partial removal of the coating of pyrolitic graphite is again necessary, that is to say along the lines 9 and 8 as shown in the drawing, of FIG. 7 and preferably also at the outer circumference of the disc. The focal path can then be provided on the one hand on the outer circumference of the disc, but also on a (cone-shaped) end face of the disc body provided with pyrolytic graphite. The cross-section (for example, along the line 8) may not extend perpendicularly to the plane of the drawing in that case, but rather at an angle along a conical surface which would intersect the growth direction of the pyrographite coating at an angle other than 90°.

Because the embodiment shown in the FIGS. 6 and 7 allows transport of heat in two directions (upwards and downwards when the focal path is provided on the outside and downwards and outwards when the focal path is provided on the upper side), this embodiment is particularly attractive for the dissipation of the heat developed in the focal spot.

What is claimed is:

1. An X-ray tube having an anode structure comprising an anode disc having a base structure of graphite, a heavy metal layer covering an area of said anode disc, said heavy metal layer serving as a focal path for an electron beam, at least two foil tapes of different widths wound about an outer circumference of said anode disc at said area, said two foil tapes each having one edge situated at least approximately in the same plane, and pyrolytic graphite filling spaces between one of said two foil tapes separated by the other of said two foil tapes, said pyrolytic graphite and said one of said foil tapes being in facing relationship to said heavy metal layer.

2. An X-ray tube according to claim 1, wherein said two foil tapes are both graphite.

3. An X-ray tube according to claim 1, wherein said anode disc is a rotary anode having an axis of rotation, and said two foil tapes and said pyrolytic graphite extend symmetrically around said axis of rotation.

4. An X-ray tube according to claim 3, wherein said two foil tapes are both graphite.

5. An X-ray tube according to claim 1, wherin said two tapes are separated from one another at a distance ranging from 0.1 to 4 mm, and wherein said two tapes each have a thickness ranging from 0.1 to 3 mm.

6. An X-ray tube having an anode structure comprising an anode disc having a base structure of graphite, said anode disc being a rotary anode having an axis of rotation, a heavy metal layer covering an area of said anode disc, said heavy metal layer serving as a focal path for an electron beam, a plurality of plates secured to said anode disc at an outer circumference at said area, said plurality of plates extending radially and symmetrically with respect to said axis of rotation, and pyrolytic graphite filling spaces between said plurality of plates, said pyrolytic graphite and said plurality of plates being in facing relationship to said heavy metal layer.

7. An X-ray tube according to claim 6, wherein said plurality of plates are graphite.

8. An X-ray tube according to claim 6, wherein said pyrolytic graphite filing said spaces between said plurality of plates is provided by deposition of carbon from a gaseous phase, said plurality of plates being arranged at a short distance from one another in rotational symmetry.

9. An X-ray tube according to claim 6, wherein said plurality of plates are situated in planes containing said axis of rotation.

10. An X-ray tube according to claim 9, wherein said pyrolytic graphite filling said spaces between said plurality of plates is provided by deposition of carbon from a gaseous phase, said plurality of plates being arranged at a short distance from one another in rotational symmetry.

11. An X-ray tube according to claim 10, wherein said plurality of plates are graphite.

12. An X-ray tube according to claim 6, wherein said plurality of plates are separated from one another at a distance ranging from 0.1 to 4 mm, and wherein said plurality of plates each have a thickness ranging from 0.1 to 3 mm.

* * * * *